United States Patent [19]

Ebihara et al.

[11] Patent Number: 4,536,750

[45] Date of Patent: Aug. 20, 1985

[54] CAR-DIRECTING APPARATUS FOR AN ALARM SYSTEM

[75] Inventors: Shigeto Ebihara, Tokyo; Atsuo Ohta, Yokohama; Kunikazu Kuwabara, Tokyo, all of Japan

[73] Assignee: Secom Co., Ltd., Tokyo, Japan

[21] Appl. No.: 507,235

[22] Filed: Jun. 23, 1983

[30] Foreign Application Priority Data

Jun. 30, 1982 [JP] Japan ..... 57-111443

[51] Int. Cl.[3] ..... G08B 1/08

[52] U.S. Cl. ..... 340/539; 340/525; 340/531; 455/54

[58] Field of Search ..... 340/539, 524, 525, 531, 340/534, 538, 825.36, 825.49, 825.55; 455/53, 54, 67, 73, 74, 89, 95, 127

[56] References Cited

U.S. PATENT DOCUMENTS

| | | | |
|---|---|---|---|
| 3,713,125 | 1/1973 | Miller | 340/539 |
| 3,864,674 | 2/1975 | Worsham et al. | 340/539 |
| 3,914,692 | 10/1975 | Seaborn, Jr. | 340/539 |
| 3,925,763 | 12/1975 | Wadhwani et al. | 340/539 |
| 4,083,003 | 4/1978 | Haemmig | 340/525 |
| 4,101,873 | 7/1978 | Anderson et al. | 340/539 |
| 4,455,551 | 6/1984 | Lemelson | 340/539 |

*Primary Examiner*—Donnie L. Crosland

*Attorney, Agent, or Firm*—Armstrong, Nikaido, Marmelstein & Kubovcik

[57] ABSTRACT

A car-directing apparatus for an alarm system, directing dispatched engineers in a dispatch car to the site of an emergency or abnormality. The car-directing apparatus is fixedly arranged in a part of a predetermined area protected by the alarm system and has a display unit capable of indicating the site of the emergency or abnormality and/or a signal emitter for emitting a car-directing signal toward the dispatch car when the car approaches the site of the emergency or abnormality. The car-directing apparatus also has a built-in electric power unit including a chargeable battery.

6 Claims, 8 Drawing Figures

61
CENTRAL STATION
6
CENTRAL MONITORING DEVICE
51
5
41, 71 or 81
4, 7 or 8
CAR-DIRECTING APPARATUS
9
21
SECURITY-ENSURING APPARATUS
SIGNAL TRANSMITTER
2
3
G
1
EMERGENCY SENSORS

CAR-DIRECTING APPARATUS FOR AN ALARM SYSTEM

BACKGROUND OF THE INVENTION

1. Field of the Invention

The present invention relates to an indispensable component unit of an alarm system for securing a predetermined area, such as the user's office or residence, against unauthorized intrusions, the destruction of or removal of property, fire, equipment failure, etc. More particularly, the present invention relates to an apparatus arranged in the predetermined area for directing an engineer or engineers dispatched in a car or cars to a designated area where an emergency or abnormality has occurred, i.e., the site of an emergency or abnormality. For the sake of brevity, this apparatus is referred to as a car-directing apparatus throughout the specification, the claims, and the accompanying drawings.

2. Description of the Prior Art

In conventional alarm systems, a security-ensuring apparatus is arranged in a predetermined protected area, such as the residence or office of the system's user or a public facility. An emergency or abnormality occurring in the predetermined area is thus detected by the security-ensuring apparatus. The apparatus then automatically transmits an emergency or abnormality signal, via an associated signal transmitter, to a central station which has a monitoring unit for continuously monitoring every alarm system connected thereto. The central station then dispatches authorized personnel, i.e., engineers, to the site of the emergency or abnormality in a car or cars. However, it often happens that the dispatched engineers fail to quickly arrive at the site of the emergency or abnormality since the conventional alarm system uses emergency-indicating lamps located outside the protected area and lit by commercial electric power. The employment of commercial electric power often limits proper location of the lamps due to the complexity of electric wiring, damage to the outside wall of the user's residence or office, and so on. As a result, the conventional emergency-indicating lamps are not certain to function so as to direct the dispatched engineers to the site of the emergency or abnormality. In addition, if the dispatched engineers are not fully familiar with the protected area and if they have to go to the site of the emergency or abnormality at night, they are apt to lose their way or it takes them a long time to arrive at the site of the emergency or abnormality since the conventional alarm system has no effective means for giving direction to the dispatched engineers. This drawback has become more apparent since the number of users of the alarm system has recently increased.

SUMMARY OF THE INVENTION

An object of the present invention is to eliminate the above-mentioned drawbacks encountered in the conventional alarm system.

Another object of the present invention is to provide a car-directing apparatus for an alarm system, which apparatus is designed so as to be powered by a battery.

A further object of the present invention is to provide a battery-powered car-directing apparatus for an alarm system, which apparatus is capable of giving to engineers dispatched in a car not only visual and/or acoustic directions but also directions transmitted over a radio.

In accordance with the present invention, there is provided a car-directing apparatus which is incorporated into an alarm system for securing a predetermined protected area against an emergency and/or abnormality and which directs engineers dispatched in a car to the predetermined area when an emergency and/or abnormality occurs. The apparatus is fixedly arranged in a part of the predetermined protected area so as to be electrically intermittently powered by a built-in electric power unit which includes a battery means. The apparatus directs the engineers dispatched in a car or cars to the predetermined protected area by means of a display unit, which includes alarm lamps which are lit when emergency and/or alarm buzzers sound when an emergency or abnormality occurs. The apparatus may preferably direct the engineers dispatched in a car or cars by emitting a radio signal toward the car or cars.

BRIEF DESCRIPTION OF THE DRAWINGS

The present invention will be more apparent from the ensuing description of the preferred embodiments, with reference made to the accompanying drawings, wherein:

Referring to FIG. 1, the car-directing apparatus 4, 7, or 8 of the present invention is incorporated, as an indispensable component device, into an alarm system for a predetermined protected area G, for example, the user's residence. In the user's residence, there are arranged diverse kinds of emergency or abnormality sensors 1, such as fire sensors, gas-leakage sensors, unauthorized intrusion sensors, equipment-failure sensors, panic buttons, etc., a security-ensuring apparatus 2 connected to the sensors 1 for concentrically monitoring information transmitted from the sensors 1, an antenna 21 attached to the security-ensuring apparatus 2 for emitting and receiving radio signals, and a signal transmitter 3 electrically connected to the security-ensuring apparatus 2. The emergency or abnormality sensors 1 are arranged, respectively, in appropriate places within the protected area G. A signal from the signal transmitter 3 is sent, via a signal transmission line 9, to a central monitoring device 6 of the central station for centrally monitoring a plurality of like alarm systems to ensure the security of a corresponding number of user's residences or offices. The central monitoring device 6 has an antenna 61 for emitting and receiving radio signals. A car or cars 5 are provided for transporting dispatched engineers to the site of the emergency or abnormality, i.e., the protected area G. The car 5 has an antenna 51 for emitting and receiving radio signals. Directions to the designated area, i.e., the site of the emergency or abnormality, are given to the dispatched engineers by the car-directing apparatus 4, 7, or 8. In the system of FIG. 1, the signal transmission line 9 may be a telephone cable, a private cable, a leased line, or a radio.

Referring to FIG. 2A, which illustrates the car-directing apparatus 4 according to the first embodiment of the present invention, the apparatus 4 has: a signal-receiving circuit 42 which receives an emergency- or abnormality-information signal in the form of a coded and modulated signal from the security-ensuring apparatus 2 (FIG. 1), via the antenna 41; a signal-demodulating circuit 43 which demodulates the signal from the circuit 42; a memory unit 44 which stores the code of the user of the apparatus 4, the machine code of the car-directing apparatus 4, a pilot signal code, and emergency-discriminating codes, each corresponding to each type of emergency or abnormality sensed by the emergency or abnormality sensors 1 (FIG. 1); a discriminating unit 45 which discriminates whether or not the signal coming from the signal-demodulating circuit 43 is true, based on the above-mentioned codes read from the memory unit 44; a solenoid relay RD which is energized when the discriminating circuit discriminates that a certain emergency or abnormality has truely occurred in the protected area G (FIG. 1); a display unit 47 having lamps which light and/or buzzers which sound to indicate that an emergency or abnormality has actually occurred; and an electric power unit 46, which comprises a solar battery 461, a charging circuit 462, a pair of secondary batteries 463 and 464, such as lead storage batteries, a pulse oscillator 465, and two solenoid relays RR and RS.

Referring to FIG. 2B, the memory unit 44 includes three separate memory circuits 441, 442, and 443. The memory circuit 441 stores the code of a pilot signal to be emitted in advance of an emergency- or abnormality-information signal emitted by the security-ensuring apparatus 2 (FIG. 1). The memory circuit 442 stores therein the aforementioned user's and machine codes. The memory circuit 443 sotres the signal-discriminating codes.

The discriminating unit 45 comprises a pilot-signal discriminating circuit 451, a code-correspondence discriminating circuit 452, an emergency-discriminating circuit 453, three addressing circuits 454, 455, and 456, a drive circuit 457 for electrically driving the solenoid relay RD (FIG. 2A), a timer circuit 458, a drive circuit 459 for electrically driving the solenoid relay RR (FIG. 2A), and a contact rS of the relay RS. FIG. 2B also illustrates the electric interconnection among the above-mentioned circuits of the memory unit 44 and the discriminating unit 45.

Figure 1:
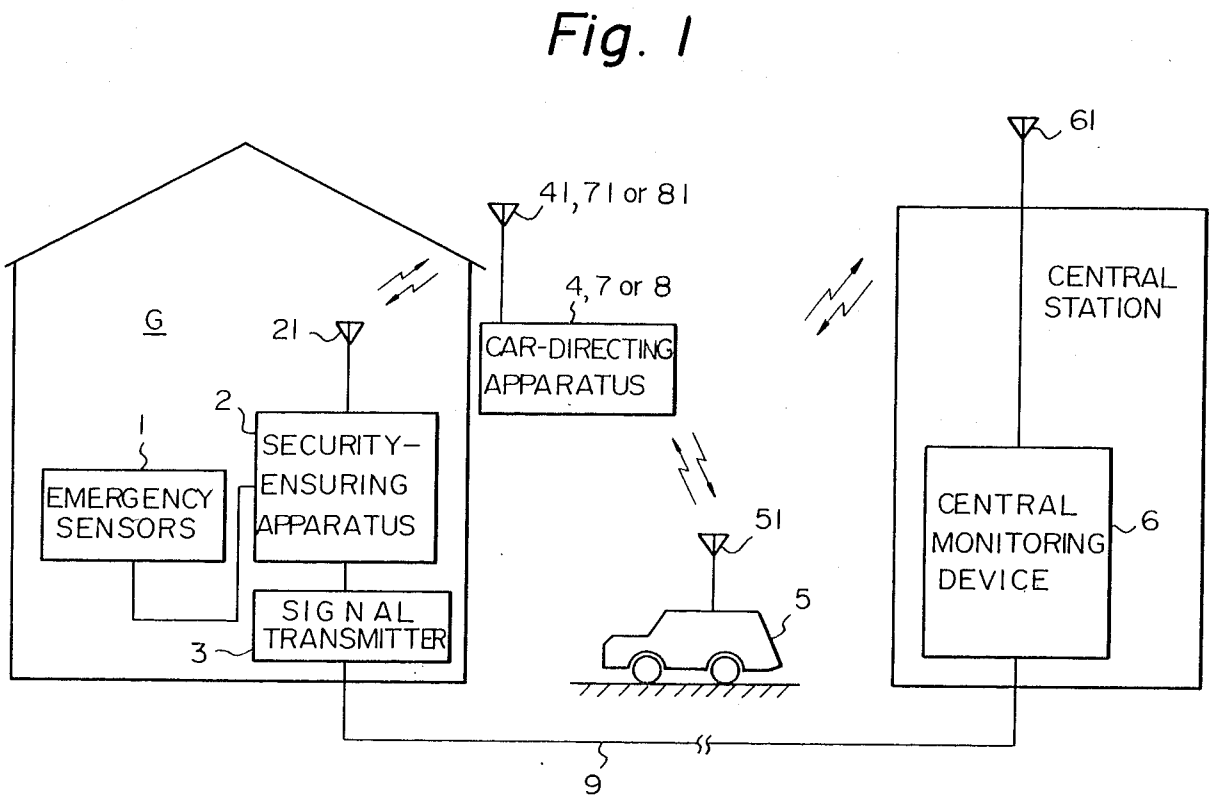
FIG. 1 is a schematic block diagram of an alarm system in which a car-directing apparatus according to the present invention is incorporated.

The operation of the car-directing apparatus 4 is now described with reference to FIGS. 1, 2A, and 2B.

When the emergency sensors 1 arranged in the protected area G sense an emergency or abnormality, an emergency or abnormality signal is transmitted to the security-ensuring apparatus 2 by radio or wire. The security-ensuring apparatus 2 then displays the site of the emergency or abnormality, as well as the type of emergency or abnormality, on a built-in displayer (not shown) and simultaneously sends an emergency- or abnormality-information signal to the central monitoring device 6 of the central station via the signal transmitter 3 and the signal transmission line 9. The security-ensuring apparatus 2 also sends a radio emergency-information signal to the car-directing apparatus 4 so that the apparatus 4 turns on the lamps of the display unit 47 and/or sounds an alarm by sounding the buzzers of the display unit 47. The central station, located remote from the protected area G, has radio communication with an appropriate dispatch car 5 to immediately dispatch engineers to the site of the emergency or abnormality upon the receipt of an emergency-information signal.

Figure 2A:
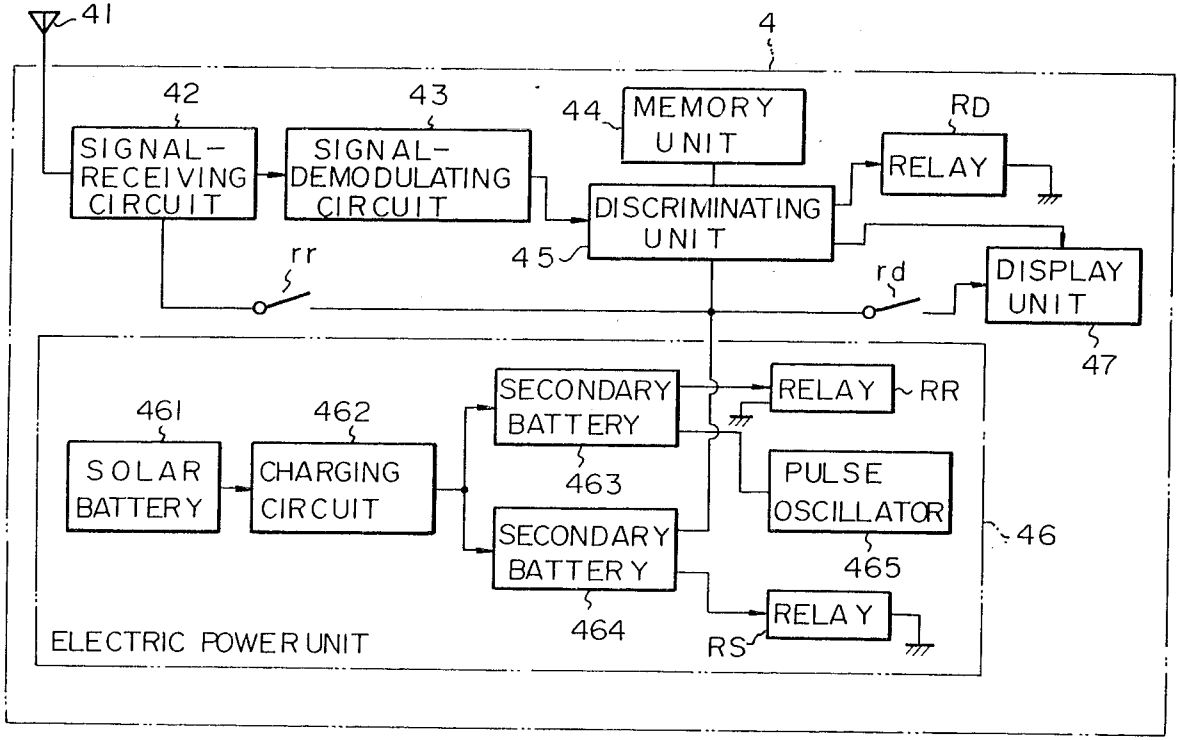
FIG. 2A is a block diagram of a car-directing apparatus according to an embodiment of the present invention.
Figure 2B:
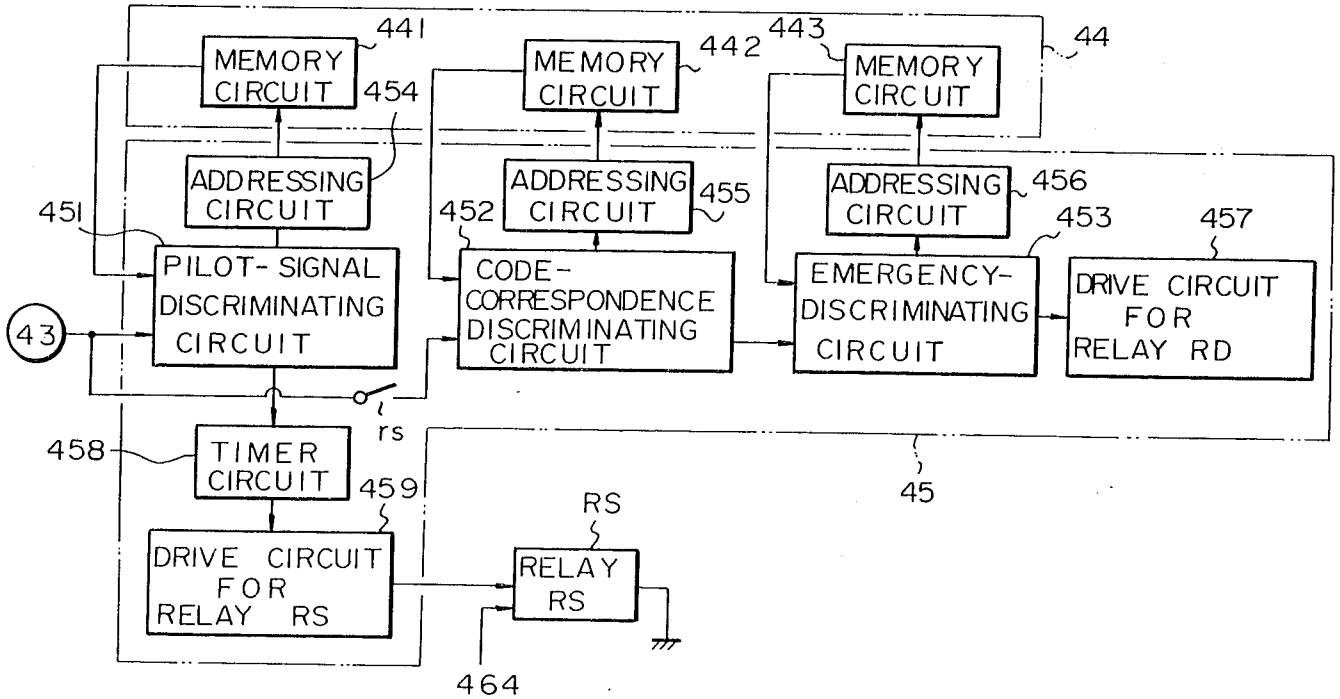
FIG. 2B is a detailed block diagram of part of the apparatus of FIG. 2A.

As is shown in FIG. 2A, the car-directing apparatus 4 is electrically powered by the electric power unit 46. In the electric power unit 46, the pulse oscillator 465 always issues a train of pulses having a width of scores of milliseconds and a frequency shorter than the width of a pilot signal emitted by the security-ensuring apparatus 2. The solenoid relay RR is energized for the time period of each pulse of the pulse oscillator 465 so that the contact rr thereof is closed. Accordingly, the apparatus 4 is capable of receiving an emergency- or abnormality-information signal only for the time period of each pulse of the pulse oscillator 465. As a result, when the security-ensuring apparatus 2 initially emits the pilot signal, the pilot signal is received by the signal-receiving circuit 42 of the car-directing apparatus 4. The pilot signal is emitted for a few seconds. The pilot signal received by the signal-receiving circuit 42 is then sent to the demodulating circuit 43, where it is demodulated into a coded pilot signal, which is in turn sent to the discriminating unit 45. In the discriminating unit 45, the coded pilot signal is input into the pilot-signal discriminating circuit 451 and is not input into the code-correspondence discriminating circuit 452 since the contact rs of the relay RS is open. In the pilot-signal discriminating circuit 451, the input signal is discriminated on the basis of the pilot signal code read out of the memory circuit 441 via the addressing circuit 454. When the code of the input signal coincides with that of the pilot signal read out of the memory circuit 441, the circuit 451 operates the timer circuit 458, which in turn operates the drive circuit 459 for a predetermined time period, for example, ten seconds. As a result, the relay RS is driven by the drive circuit 459 so that the contact rs thereof is closed for ten seconds.

On the other hand, the security-ensuring apparatus 2 transmits, after the pilot signal, an emergency-information signal to the apparatus 4. The emergency-information signal, which includes the user's code signal, the machine-code signal, and an abnormality signal, is received by the signal-receiving circuit 42 and is then demodulated by the signal-demodulating circuit 43 into a coded emergency-information signal which is sent to the discriminating unit 45.

In the discriminating unit 45, the coded emergency-information signal is input into the code-correspondence discriminating circuit 452 through the closed contact rs. In the code-correspondence discriminating circuit 452, it is discriminated whether or not the user's code and the machine code of the input signal coincide with respective codes preliminarily stored in and read out of, via the addressing circuit 455, the memory circuit 442. When a coincidence is discriminated, the input signal is further sent to the emergency-discriminating circuit 453 so that the type of emergency is discriminated on the basis of the codes read out of the memory circuit 443 via the addressing circuit 456. When it is ascertained that the abnormality signal of the input emergency-information signal coincides with one of the codes stored in the memory circuit 443, the emergency-discriminating circuit 453 operates the drive circuit 457, which in turn energizes the relay RD. As a result, the contact rd (FIG. 2A) is closed. Accordingly, the abnormality signal is sent to the display unit 47. The display unit 47 then displays the emergency or abnormality. That is, the lamps are lit and/or the buzzers are sounded so that they may direct the engineers dispatched in the car 5 (FIG. 1) to the protected area G (FIG. 1).

When an emergency or abnormality in the protected area G is brought under control, the security-ensuring apparatus 2 again transmits a pilot signal and a subsequent signal indicating the bringing under control of the emergency or abnormality to the car-directing apparatus 4. Therefore, in the car-directing apparatus 4, the pilot signal and the emergency- or abnormality-under-control signal are discriminated in the same manner as the aforementioned emergency-information signal. As a result, when it is ascertained that the emergency or abnormality is under control, the relay RD is de-energized so that the contact rd is reopened. Consequently, operation of the display unit 47 is stopped, i.e., the lamps are turned off and/or sounding the alarm buzzers is stopped. Accordingly, the car-directing operation of the apparatus 4 is stopped.

From the foregoing description, it will be understood that the car-directing apparatus 4 is powered by the built-in electric power unit 46, which includes a solar battery and needs no conventional electric wiring to connect it to commercial electric power. Therefore, it is easy to choose a suitable location for the apparatus 4 for directing the engineers dispatched in the car 5.

Figure 3A:
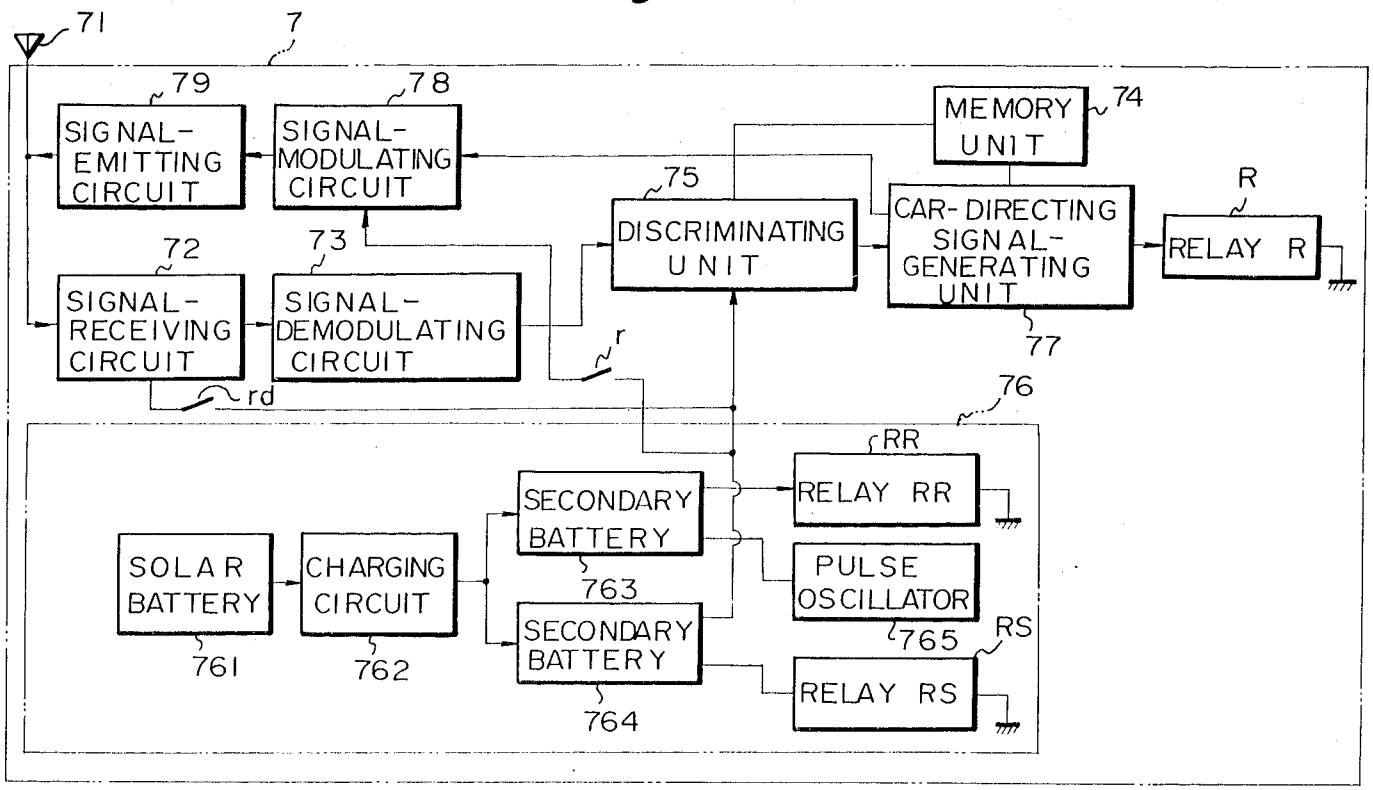
FIG. 3A is a block diagram of a car-directing apparatus according to another embodiment of the present invention.

Referring to FIG. 3A, which illustrates the car-directing apparatus 7 according to the second embodiment of the present invention, the apparatus 7 comprises an antenna 71 for radio communication with the security-ensuring apparatus 2 and the engineers dispatched in the car 5 (FIG. 1), a signal-receiving circuit 72 which receives an emergency-information signal transmitted from the security-ensuring apparatus 2 (FIG. 1), a signal-demodulating circuit 73 which demodulates the emergency-information signal received by the signal-receiving circuit 72, a discriminating unit 75 which discriminates whether or not the demodulated emergency-information signal is a true emergency information signal with respect to the protected area G (FIG. 1), a memory unit 74 which stores the code of the user of the present car-directing apparatus 7, the machine code of the present apparatus 7, a pilot signal code, and signal-discriminating codes, each corresponding to each type of emergency or abnormality detected by the emergency sensors 1 (FIG. 1), a car-directing signal-generating unit 77 which generates a car-directing signal on the basis of the true emergency-information signal supplied from the discriminating unit 75, a signal-modulating circuit 78 which modulates the car-directing signal supplied from the car-directing signal-generating unit 77, a signal-emitting circuit 79 which emits the modulated signal supplied from the signal modulating circuit 78 in the form of a radio transmission signal via the antenna 71, and an electric power unit 76 built into the apparatus 7 in the form of a chargeable battery having a solar battery 761. It should be noted that the construction and the function of the circuits and units 72 through 76 are substantially the same as those of the corresponding circuits and units 42 through 46 of the first embodiment. The car-directing apparatus 7 is characterized in that it is powered by a built-in battery and operates so as to direct the engineers dispatched by car 5 to the designated area, i.e., the site of the emergency or abnormality, by the use of a radio transmission signal.

Figure 3B:
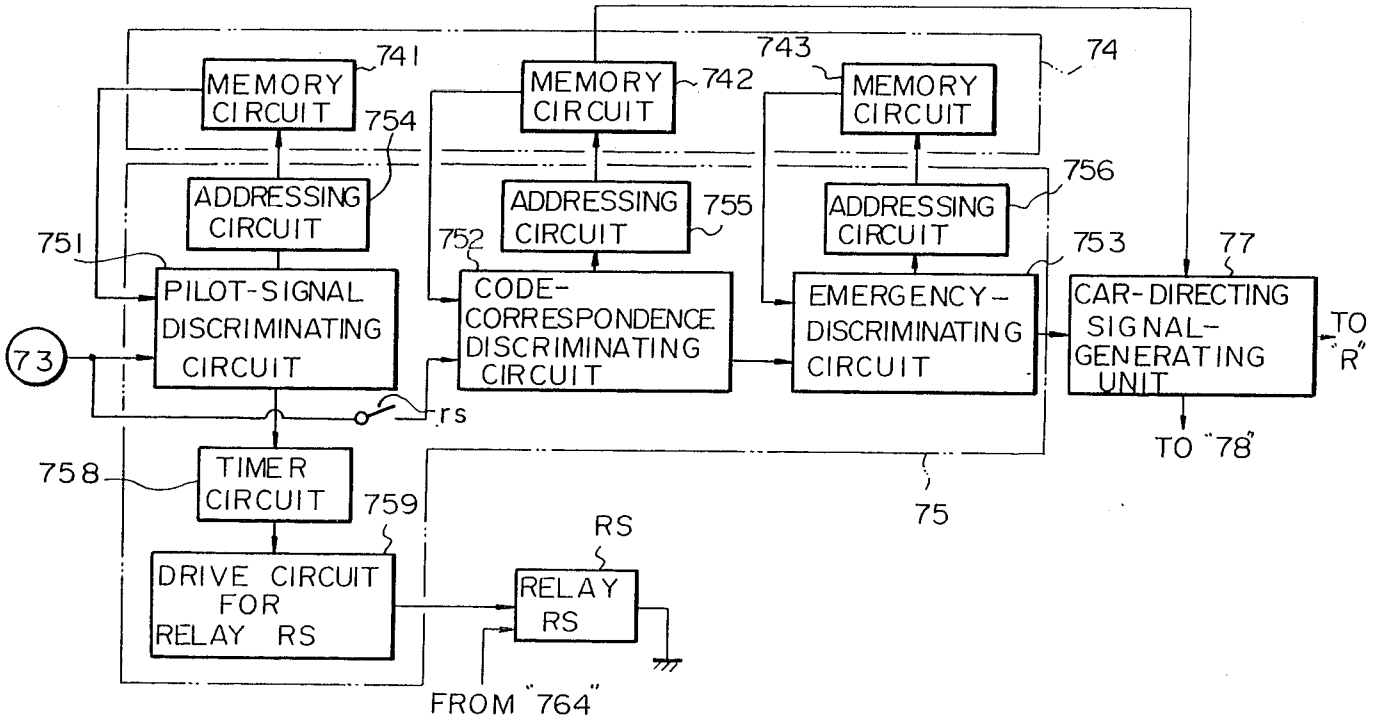
FIG. 3B is a detailed block diagram of part of the apparatus of FIG. 3A.

As is shown in FIG. 3B, the memory unit 74 comprise three separate memory circuits 741 through 743 which correspond to the three memory circuits 441 through 443 of the first embodiment, respectively. Further, the discriminating unit 75 comprises a pilot-signal discriminating circuit 751, a code-correspondence discriminating circuit 742, an emergency-discriminating circuit 753, and three addressing circuits 754 through 756. These circuits 751 through 756 substantially correspond to the circuits 451 through 456 of the first embodiment shown in FIG. 2B, respectively. The memory unit 74 and the discriminating unit 75 of FIG. 3B are different from the memory unit 44 and the discriminating unit 45 of FIG. 2B in that the memory circuit 742 and the emergency-discriminating circuit 753 are respectively connected to the car-directing signal-generating unit 77.

Figure 3C:
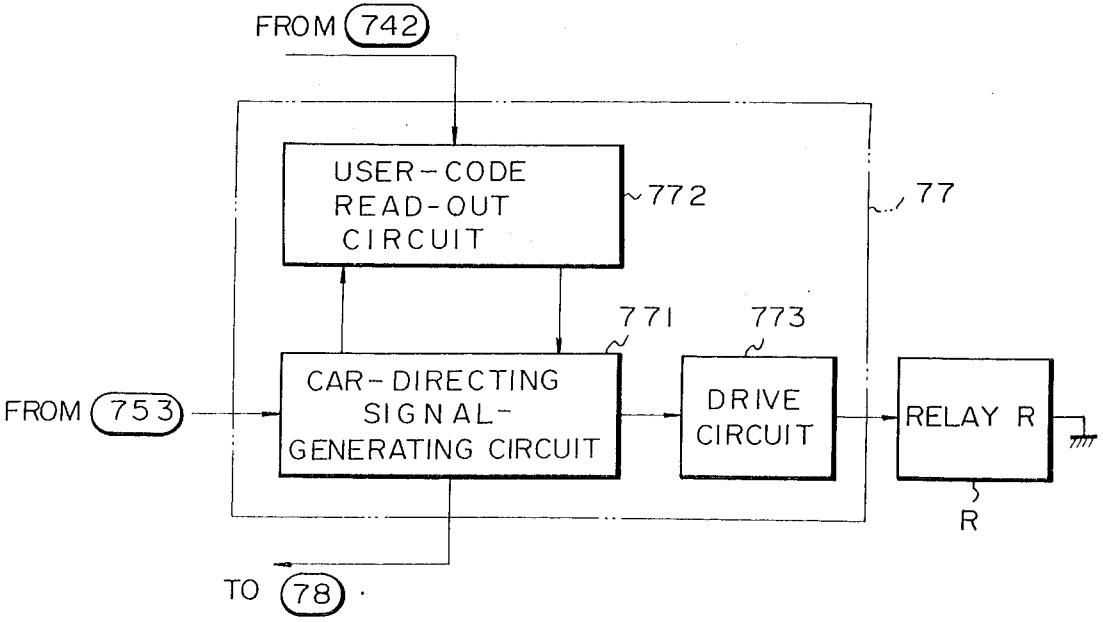
FIG. 3C is a detailed block diagram of another part of the apparatus of FIG. 3A.

The car-directing signal-generating unit 77 comprises, as is shown in FIG. 3C, a car-directing signal-generating circuit 771, a user-code read-out circuit 772, and a drive circuit 773. The car-directing signal-generating circuit 771 is connected to the emergency-discriminating circuit 753 (FIG. 3B) of the discriminating unit 75, the memory circuit 742 (FIG. 3B) of the memory unit 74 via the user-code read-out circuit 772, and the signal-modulating circuit 78. The drive circuit 773 electrically drives the relay R (FIG. 3A).

The operating of the car-directing apparatus 7 of the second embodiment is described hereinbelow with reference to FIG. 1 and FIGS. 3A through FIG. 3C.

When an emergency-information signal in the form of a modulated coded signal is transmitted from the security-ensuring apparatus 2 through the antenna 21, it is received by the signal-receiving circuit 72 through the antenna 71. The modulated coded emergency-information signal is then demodulated by the signal-demodulating circuit 73 into a coded emergency-information signal. At this stage, it should be understood that the coded emergency-information signal is formed from an initial coded pilot signal and a subsequent coded emergency signal. The coded emergency-information signal is then sent to the discriminating unit 75, in which it is subjected to a discrimination operation while it passes through the pilot signal-discriminating circuit 751, the code-correspondence discriminating circuit 752, and the emergency-discriminating circuit 753. That is to say, it is discriminated whether or not the coded emergency-information signal is a true emergency signal having occurred in the predetermined protected area G (FIG. 1). The type of emergency and/or abnormality is also discriminated by the discriminating unit 75. As a result, if it is ascertained that the signal is a true emergency signal, the signal is sent to the car-directing signal-generating circuit 771 of the car-directing signal-generating unit 77 so as to drive the circuit 771. Therefore, the circuit 771 reads out the user's code from the memory circuit 742 of the memory unit 74 via the user-code read-out circuit 772 and generates a coded car-directing signal by adding the user's code to the emergency-information signal. At the same time, the circuit 771 also energizes the relay R, which in turn closes its contact r. Thus, the coded car-directing signal is sent to the electrically powered signal-modulating circuit 78 so that it is modulated into a signal suited for being transmitted as a radio transmission signal. The signal is further sent to the signal-emitting circuit 79, from which it is emitted as a radio car-directing transmission signal toward the dispatch car 5 through the antenna 71. Therefore, the dispatch car 5 is able to transport the dispatched engineers to the protected area G. Upon arrival at the area G, the dispatched engineers quickly execute necessary operation to bring the emergency and/or abnormality under control.

When the emergency and/or abnormality is under control, the security-ensuring apparatus 2 again transmits an emergency-information signal formed from an initial pilot signal and a sebsequent emergency-under-control signal. The emergency-information signal is received by the signal-receiving circuit 72 of the car-directing apparatus 7. The emergency-information signal is further sent to the discriminating unit 75, in which it is subjected to a discriminating operation to discriminate whether or not the signal is a true emergency-under-control signal. If it is ascertained that the signal is a true emergency-under-control signal, the signal is sent to the car-directing signal-generating unit 77 so as to stop the operation of the unit 77. As a result, the relay R is de-energized so that the contact r thereof is restored to the open state. Thus, radio transmission of the car-directing signal from the signal-emitting circuit 79 is eventually stopped.

Figure 4A:
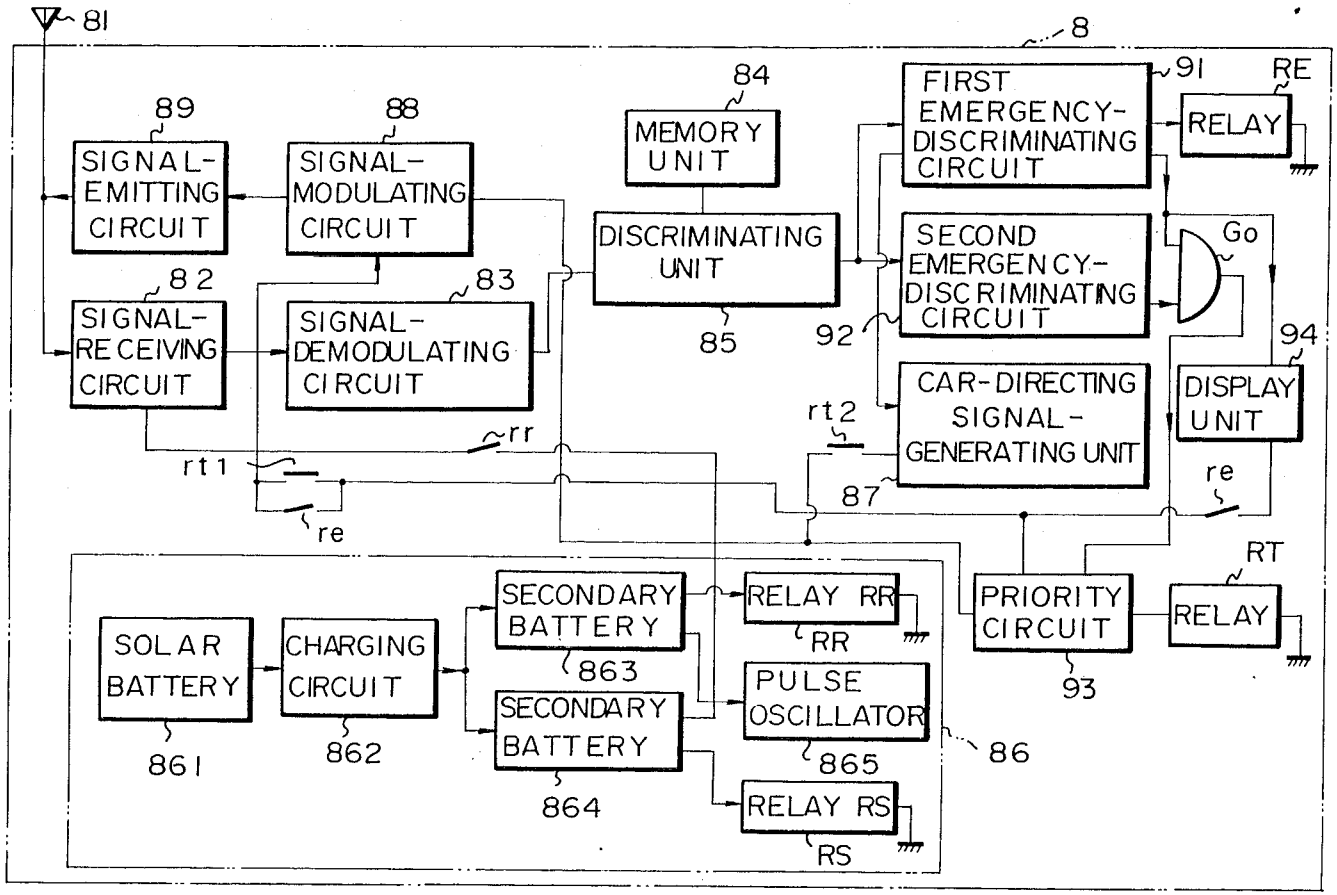
FIG. 4A is a block diagram of a car-directing apparatus according to a further embodiment of the present invention.

Referring to FIG. 4A, which illustrates the car-directing apparatus 8 of the third embodiment, the apparatus 8 comprises an antenna 81 for receiving and emitting a radio transmission signal, such as an emergency-information signal, car-directing signal, and other signals described later. The apparatus 8 also comprises a signal-receiving circuit 82 for receiving, through the antenna 81, an emergency-information signal, which includes an emergency signal or an emergency-under-control signal transmitted from the security-ensuring apparatus 2 (FIG. 1), and a confirmation signal transmitted from the dispatch car 5 (FIG. 1). The apparatus further comprises a signal-demodulating circuit 83 connected to the signal-receiving circuit 82, for demodulating each signal coming from the circuit 82, a memory unit 84 for storing therein the user's code, the machine code, a pilot signal code, a confirmation signal code, and emergency-discriminating codes, a discriminating unit 85 connected to the signal-demodulating circuit 83 for discriminating the type of emergency and the source of signal transmission, i.e., the security-ensuring apparatus 2 or the dispatch car 5, when a signal is input into the circuit 83, a first emergency-discriminating circuit 91 connected to the discriminating unit 85 and capable of operating when it is discriminated by the unit 85 that the signal came from the apparatus 2, a second emergency-discriminating circuit 92 also connected to the discriminating unit 85 and capable of operating when it is discriminated by the unit 85 that the signal came from the dispatch car 5, a car-directing signal-generating circuit 87 for generating a car-directing signal in response to the signal supplied from the first emergency-discriminating circuit 91, an AND gate circuit $G_0$ connected to both the first and second emergency-discriminating circuits 91 and 92 and issuing an output signal when both inputs thereof receive signals from the circuits 91 and 92, a priority circuit 93 for generating a prior emergency signal when the circuit 93 receives a signal from the AND gate circuit $G_0$, a display unit 94 including alarm lamps and/or buzzers energized when a signal is supplied from the first emergency-discriminating circuit 91, a signal-modulating circuit 88 connected to the circuit 91, a signal-emitting circuit 89, and an electric power unit 86 which includes a solar battery 861, a charging circuit 862, and two secondary batteries 863 and 864. The electric power unit 86 is arranged so as to intermittently electrically power the aforementioned circuits and units.

Figure 4B:
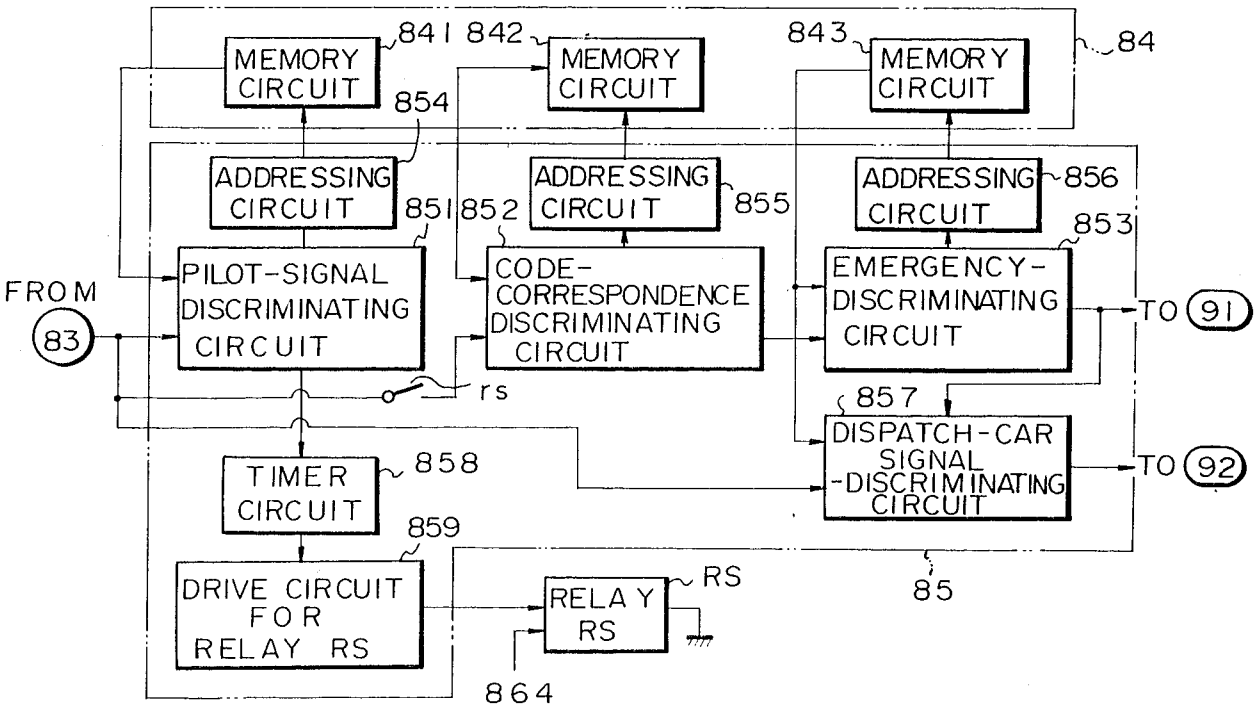
FIG. 4B is a detailed block diagram of part of the apparatus of FIG. 4A.

As is shown in FIG. 4B, the memory unit 84 comprises three memory circuits 841, 842, and 843. The memory circuit 841 stores therein the pilot signal code. The memory circuit 842 stores therein the user's code and the machine code. The memory circuit 843 stores therein the confirmation code and the emergency-discriminating codes.

The discriminating unit 85 comprises, as is shown in FIG. 4B, a pilot-signal discriminating circuit 851, a code-correspondence discriminating circuit 852, an emergency-discriminating circuit 853, three addressing circuits 854 through 856, a dispatch-car signal-discriminating circuit 857, a timer circuit 858, and a drive circuit 859 for driving a relay RS. These circuits, except for the circuit 857, substantially correspond to the circuits 451 through 456 and 458 and 459. FIG. 4B also illustrates the interconnections among the above-mentioned circuits 851 through 859 as well as the interconnection between the three memory circuits 841 through 843 of the memory unit 84 and the circuits of the discriminating unit 85.

The operation of the car-directing apparatus 8 of the third embodiment is described hereinbelow with reference to FIGS. 1, 4A, and 4B.

When an emergency and/or abnormality is sensed in the predetermined protected area G, the security-ensuring apparatus 2 initially transmits a pilot signal toward the car-directing apparatus 8 through the antenna 21. The pilot signal continues for several seconds and is received by the signal-receiving circuit 82. The pilot signal is then demodulated by the signal-demodulating circuit 83 and is subsequently supplied to the discriminating unit 85. In the discriminating unit 85, if it is ascertained by comparing the demodulated pilot signal with the pilot signal code stored in the memory circuit 841 that the demodulated pilot signal is a true pilot signal, the unit 85 sends a signal to the electric power unit 86 via the timer circuit 858 and the drive circuit 859, so that the relay RS is energized by the secondary battery 864 for a time period of several seconds, for example, ten seconds. As a result, the contact rs of the relay RS is closed for ten seconds. Therefore, an emergency signal, transmitted from the security-ensuring apparatus 2 after the pilot signal, is input into the code-correspondence discriminating circuit 852 of the discriminating unit 85 after passing through the signal-receiving circuit 82 and the signal-demodulating circuit 83. When the signal is input into the code-correspondence discriminating circuit 852, the discriminating operation is carried out so as to ascertain whether or not the code of the signal coincides with the user's code and the machine code read out of the memory circuit 842 via the addressing circuit 855. When a coincidence is ascertained, the signal is further supplied to the emergency-discriminating circuit 853, in which the signal is compared with the type-of-emergency discriminating codes read out of the memory circuit 843 via the addressing circuit 856 in order to discriminate whether or not the signal is a true emergency signal. If it is ascertained that the signal is a true emergency signal, indicating that an emergency and/or abnormality has occurred in the predetermined protected area G, the emergency-discriminating circut 853 operates the first emergency-discriminating circuit 91 as well as the dispatch-car signal-discriminating circuit 857. As a result, the relay RE is energized by the circuit 91 so that the contacts re are closed. Closing of the contacts re continues until an emergency-information signal indicating the bringing under control of the emergency in the protected area G is supplied from the security-ensuring apparatus 2 to the car-directing apparatus 8.

As a result of the closing of the contacts re, the display unit 94 is electrically powered by the electric power unit 86. Thus, when a signal is sent from the first emergency-discriminating circuit 91 to the display unit 94, the alarm lamps of the unit 94 are lit and/or the buzzers of the unit 94 are sounded so that the engineers dispatched in the car 5 can readily find the predetermined protected area G where an emergency or abnormality has occurred. Simultaneously, the first emergency-discriminating circuit 91 sends a signal to the car-directing signal-generating unit 87 so as to operate the unit 87. The unit 87 then generates a car-directing signal which is sent, via a normally closed contact rt1 of the relay RT, to the signal-modulating circuit 88. The car-directing signal is then modulated into a signal suitable for being emitted by the signal-emitting circuit 89 as a radio car-directing signal via the antenna 81. The radio car-directing signal is thus transmitted to the dispatch car 5, which is approaching the predetermined protected area G. Since the dispatch car 5 has a radar system, the dispatched engineers can readily receive the car-directing signal. Therefore, it is ensured that the engineers dispatched in the car 5 will be directed to the designated protected area G by the car-directing signal in addition to the alarm lamps and/or the buzzers of the display unit 94. When the dispatched engineers arrive at the designated protected area G, they inspect the outside of the area G and send, via a signal transmitter, a confirmation signal to the apparatus 8 indicating that they have detected the designated area G and that an emergency has indeed occurred.

The confirmation signal transmitted is received by the signal-receiving circut 82 and is then sent to the discriminating unit 85 after being demodulated by the signal-demodulating circuit 83. In the discriminating unit 85, the confirmation signal is input into the dispatch-car signal-discriminating circuit 857, operated by the emergency-discriminating circuit 853. Therefore, the circuit 857 reads the confirmation signal code out of the memory circuit 843 in order to discriminate that the input confirmation signal is a true confirmation signal. If it is discriminated that the input confirmation signal is a true confirmation signal, the dispatch-car signal-discriminating circuit 857 sends a signal to the second emergency-discriminating circuit 92. As a result, the AND gate circuit $G_0$ receives, at both input terminals thereof, signals from the first and second emergency-discriminating circuits 91 and 92 and, accordingly, issues an output signal from the output terminal thereof to the priority circuit 93. The priority circuit 93 then energizes the relay RT so that the normally closed contact rt2 is opened. Further, the priority circuit 93 issues an emergency coded signal, which includes the predetermined user's code and a priority code, the signal-modulating circuit 88. The emergency coded signal is there modulated and is emitted, via the antenna 81, by the signal-emitting circuit 89 toward the security-ensuring apparatus 2. The emitted emergency coded signal, which includes the priority code, is received by the security-ensuring apparatus 2, via the antenna 21. Thereafter, the signal is transmitted by the signal transmitter 3 (FIG. 1), via the signal-transmission line 9, to the central monitoring device 6 of the central station. The central station then executes a predetermined security-protecting operation, such as informing the police, a fire station, and so on of the detected emergency or abnormality.

When the emergency or abnormality in the predetermined protected area G is under cotrol the security-ensuring apparatus 2 sends an emergency-information signal, which includes an emergency-under-control signal, to the car-directing apparatus 8. Therefore, the car-directing operation of the apparatus 8 is stopped.

In the apparatus 8 of the third embodiment, the dispatched engineers send a confirmation signal to the central station after they arrive at the site of the emergency or abnormality and have observed the emergency or abnormality. At this stage, they may add their identifying codes to the confirmation signal so that the confirmation signal indicates which dispatched engineers have arrived at the site of the emergency or abnormality.

Further, a conventional microprocessor may be employed for the constructing the discriminatig unit 85, the first emergency-discriminating circuit 91, the car-directing signal-generating unit 87, and the priority circuit 93. The microprocessor may also be used for controlling the intermittent operation of the electric power unit 86.

In addition, the radio transmission method used in the third embodiment may be changed to either the conventional ultrasonic transmission method or the infrared ray transmission method. Naturally, when such an alternative method is used, the radio transmission antennas 21, 41, 71, and 81 have to be replaced with appropriate convertor means.

It should be noted that the discrimination of the pilot signal may be effected by discriminating whether or not the intensity of the pilot signal received by the signal-receiving circuit during a predetermined time period reaches a predetermined level, i.e., a predetermined decibel value.

From the foregoing description of the embodiments of the present invention, it will be understood that according to the present invention the reliability of the car-directing apparatus for directing dispatched engineers in a dispatch car of an alarm system to the site of an emergency or abnormability can be enhanced due to the employment of a built-in electric power unit which includes a battery, preferably a solar battery. Further, since the apparatus is intermittently electrically powered, the life of the built-in electric power unit is very long. In addition, since the apparatus may be fixedly arranged at a proper position best suited for directing the dispatched engineers in the dispatch car or cars, the efficiency of the apparatus is increased. Accordingly, the necessary security-protecting operation for handling the emergency can be rapidly achieved.

It should be understood that the employment of the built-in electric power unit contributes to a reduction in cost since no electric wiring is required.

We claim:

1. A car-directing apparatus incorporated into an alarm system which includes emergency sensors for sensing an emergency and/or abnormality occurring in a predetermined protected area, a security-ensuring apparatus arranged in the predetermined protected area and capable of transmitting an emergency-information signal in the form of a modulated coded signal, and a dispatch car in which dispatched engineers are transported to the predetermined protected area when an emergency and/or abnormality occurs, comprising:

a signal-receiving circuit for receiving said emergency-information signal transmitted from said security-ensuring apparatus and a confirmation signal in the form of a radio transmission signal transmitted by said dispatched engineers;

a demodulating circuit connected to said signal-receiving circuit and demodulating said emergency-information signal and said confirmation signal into a coded emergency- information signal and a coded confirmation signal, respectively;

a memory unit arranged so as to store therein predetermined codes, including at least type-of-emergency discriminating codes and a confirmation signal code;

a discriminating unit arranged so as to be connected to said demodulating circuit and said memory unit and discriminating whether said emergency-information signal or said confirmation signal is input thereinto upon the receipt of each signal from said demodulating circuit, said discriminating unit issuing a signal on the basis of the discrimination thereof;

a first emergency-discriminating circuit connected to said discriminating unit so as to respond to said emergency-information signal transmitted from said security-ensuring apparatus;

a second emergency-discriminating circuit connected to said discriminating unit so as to respond to said confirmation signal transmitted by said dispatched engineers;

a car-directing signal-generating unit for generating a signal to direct said dispatched engineers in said dispatch car to said predetermined protected area when said first emergency-discriminating circuit responds to said emergency-information signal;

an AND gate circuit having input terminals connected to said first and second emergency-discriminating circuits, said AND gate circuit issuing an output signal upon the receipt of signals from both said first and second emergency-discriminating circuits;

a priority circuit arranged so as to be connected to said AND gate circuit for generating a prior emergency signal upon the receipt of said output signal from said AND gate circuit;

a display unit connected to said first emergency-discriminating circuit for displaying an emergency-information signal in response to a signal from said first emergency-discriminating circuit;

a signal-modulating circuit for modulating said prior emergency signal from said priority circuit;

a signal-emitting circuit for emitting said modulated prior emergency signal from said signal-modulating circuit; and a built-in electric power unit for electrically powering said aforementioned circuits and units of said car-directing apparatus, said electric power unit comprising a battery means.

2. A car-directing apparatus as claimed in claim 1, wherein said electro power unit further comprises a relay intermittently energized by said battery means and having a normally open contact thereof disposed between said signal-receiving circuit and said battery means, said contact being intermittently closed by said relay, thereby intermittently interconnecting between said signal-receiving circuit and said battery means.

3. A car-directing apparatus as claimed in claim 1, wherein said car-directing apparatus is fixedly arranged at a part of said predetermined protected area.

4. A car-directing apparatus as claimed in claim 1, wherein said battery means of said electric power unit includes a solar battery.

5. A car-directing apparatus as claimed in claim 3, wherein said display unit comprises alarm lamps capable of being lit so as to display said emergency information, thereby directing said dispatched engineers in said dispatch car to said predetermined protected area.

6. A car-directing apparatus as claimed in claim 3, wherein said display unit comprises alarm buzzers capable of being sounded so as to display said emergency information, thereby directing said dispatched engineers in said dispatch car to said predetermined protected area.

* * * * *